US007318780B2

(12) United States Patent
Oyama

(10) Patent No.: US 7,318,780 B2
(45) Date of Patent: Jan. 15, 2008

(54) GOLF CLUB

(75) Inventor: Hitoshi Oyama, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 11/269,794

(22) Filed: Nov. 9, 2005

(65) Prior Publication Data

US 2006/0116217 A1 Jun. 1, 2006

(30) Foreign Application Priority Data

Dec. 1, 2004 (JP) ..... 2004-348839

(51) Int. Cl.
*A63B 53/04* (2006.01)
*A63B 53/10* (2006.01)

(52) U.S. Cl. ..... 473/319; 473/349

(58) Field of Classification Search ..... 473/319, 473/349

See application file for complete search history.

(56) References Cited

U.S. PATENT DOCUMENTS 5,439,219 A * 8/1995 Vincent ..... 473/319
5,772,526 A * 6/1998 Hano ..... 473/314
6,322,458 B1 * 11/2001 Kusumoto et al. ..... 473/316
6,652,389 B2 * 11/2003 Hisamatsu et al. ..... 473/319
2003/0032500 A1 * 2/2003 Nakahara et al. ..... 473/345
2005/0037860 A1 * 2/2005 Gilbert et al. ..... 473/342

FOREIGN PATENT DOCUMENTS

JP 1-166781 * 6/1989
JP 11-155987 A 6/1999
JP 11-299943 A 11/1999
JP 2003-169871 A 6/2003

* cited by examiner

*Primary Examiner*—Stephen Blau
(74) *Attorney, Agent, or Firm*—Birch, Stewart, Kolasch & Birch, LLP

(57) ABSTRACT

A golf club comprises a club shaft having a tip end and a butt end, a club head being attached to the tip end of the club shaft, and a golf grip being attached to a region of the club shaft extending from the butt end toward the tip end of the club shaft, the grip having an end by the side of the butt end of the club shaft, wherein the club head has an moment (M) of inertia around a center line of the club shaft of not less than 6500 g·cm$^2$, and the club shaft has a bending stiffness (E) of not less than $5.0\times10^6$ kgf·mm$^2$ at the position which separates 200 mm from the end of the grip toward the club head.

8 Claims, 9 Drawing Sheets

(UNIT : mm)

GOLF CLUB

BACKGROUND OF THE INVENTION

1. Field of the Invention

The present invention relates to a golf club which can improve a carry and a directionality of a hit ball by inhibiting a toe down phenomenon during a swing.

2. Description of the Related Art

In general, a wood-type golf club in recent years has a club head with a large volume and a large moment of inertia around a center of gravity of the club head. The head mentioned above can make a rotation of the club head around the center of gravity of the club head small, in the case of hitting the ball at the other positions than a sweet spot on the club face. This is useful for improving a directionality of the hit ball.

Further, in the club head with a large volume, as shown in FIG. 8, there is a tendency that a distance "A" of the center of gravity corresponding to the shortest distance between a center of gravity G of the club head "a" and a center line c of the club shaft "b" becomes large. Accordingly, in the club head "a", there is a tendency that a moment of inertia around the center line c of the club shaft b also becomes large.

Further, in accordance with a general structure of the golf club, the center of gravity G of the club head "a" exists at a position which is apart sideward from the center line c of the club shaft b. Accordingly, as shown in FIG. 9. the club head "a" moves so as to get to the center of gravity G thereof close to a swing plane d on the basis of a grip position, due to a centrifugal force during a swing. As a result, the club shaft b is bent, and there is generated a phenomenon so-called "tow down" whereby the toe a1 of the club head "a" drops downward (in other words, the club head "a" hangs toward the ground g side).

A large toe down during the swing changes the lie angle of the club head "a" to an unexpected direction. Accordingly, the position of the hitting point of the club face tends to disperse widely. Particularly, if the lie angle of the club head "a" at the moment of hitting the ball is changed, the loft angle and the face angle of the club head "a" are also changed, thereby adversely affecting the carry and directionality of the hit ball. In other words, if a large toe down is generated, it is impossible to obtain the directionality and the carry of the hit ball even by making the head large in size.

SUMMARY OF THE INVENTION

The present invention is made by taking the problem mentioned above into consideration, and a main object of the present invention is to provide a golf club which stabilizes the carry and directionally of a hit ball by restricting a large toe down during the golf swing.

In accordance with the present invention, the golf club comprises a club shaft having a tip end and a butt end, a club head being attached to the tip end of the club shaft, and a golf grip being attached to a region of the club shaft extending from the butt end toward the tip end of the club shaft, the golf grip having an end by the side of the butt end of the club shaft, wherein the club head has an moment (M) of inertia around a center line of the club shaft of not less than 6500 g·cm$^2$, and the club shaft has a bending stiffness (E) of not less than $5.0\times10^6$ kgf·mm$^2$ at the position which separates 200 mm from the end of the golf grip toward the club head.

DESCRIPTION OF THE PREFERRED EMBODIMENTS

Embodiment of the present invention will now be described in detail in conjunction with the accompanying drawings.

The golf club 1 according to the present embodiment comprises: a club shaft 2 with a tip end 2A and a butt end 2B; a club head 3 attached to the tip end 2A of the club shaft 2; and a golf grip 4 attached to a region Y of the club shaft 2 extending from the butt end 2B toward the tip end 2A of the club shaft 2. The golf grip 4 comprises an end 4*e* by the side of the butt end 2B of the club shaft 2.

The golf club 1 in accordance with the present embodiment is shown as a wood-type golf club at least including a brassy (#2), a spoon (#3) and a baffy (#4) or a cleek (#5), in addition to a driver (#1).

Figure 1:
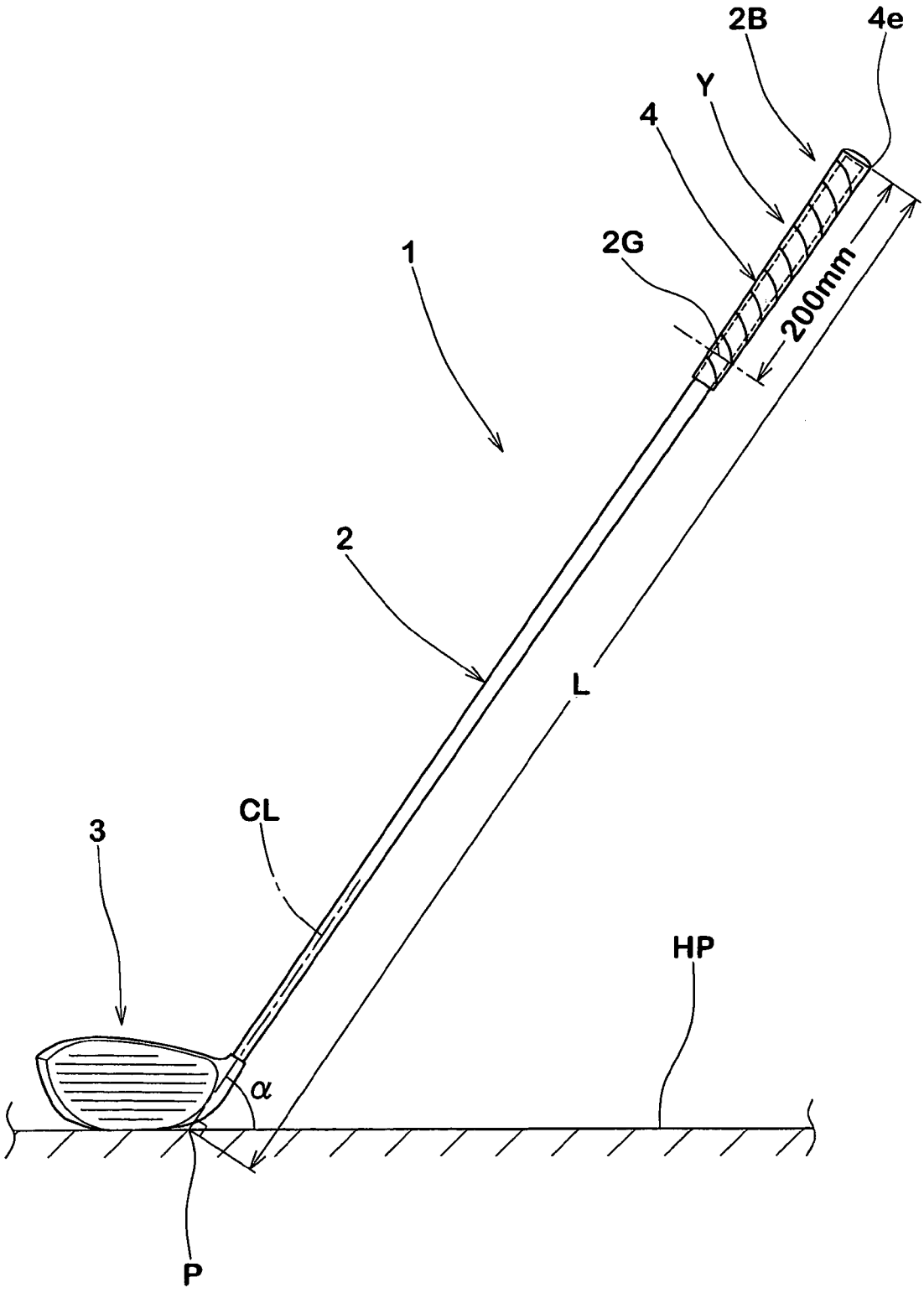
FIG. 1 is a front elevational view of a standard condition corresponding to an embodiment of a golf club in accordance with the present invention.
Figure 2:
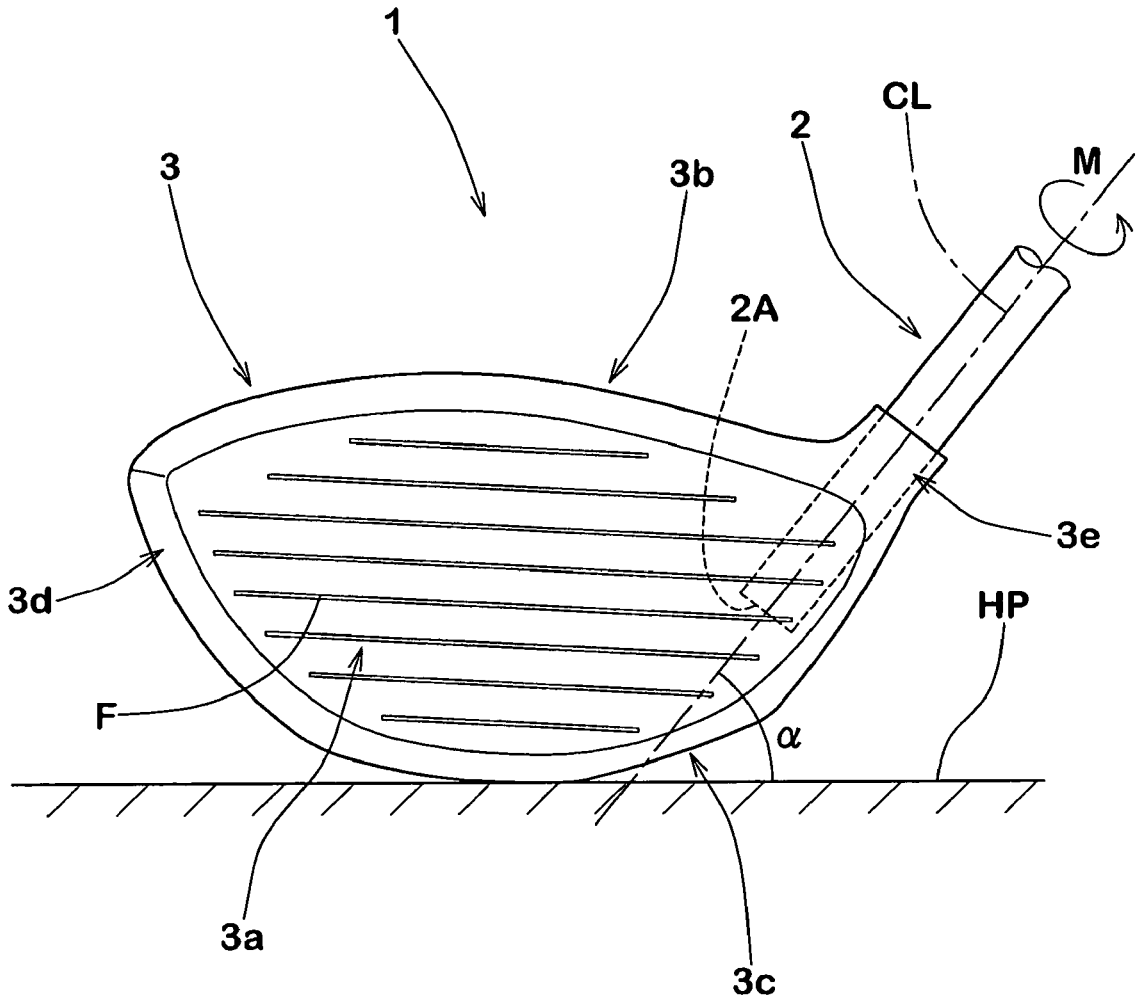
FIG. 2 is a partly enlarged view of the same.
Figure 3:
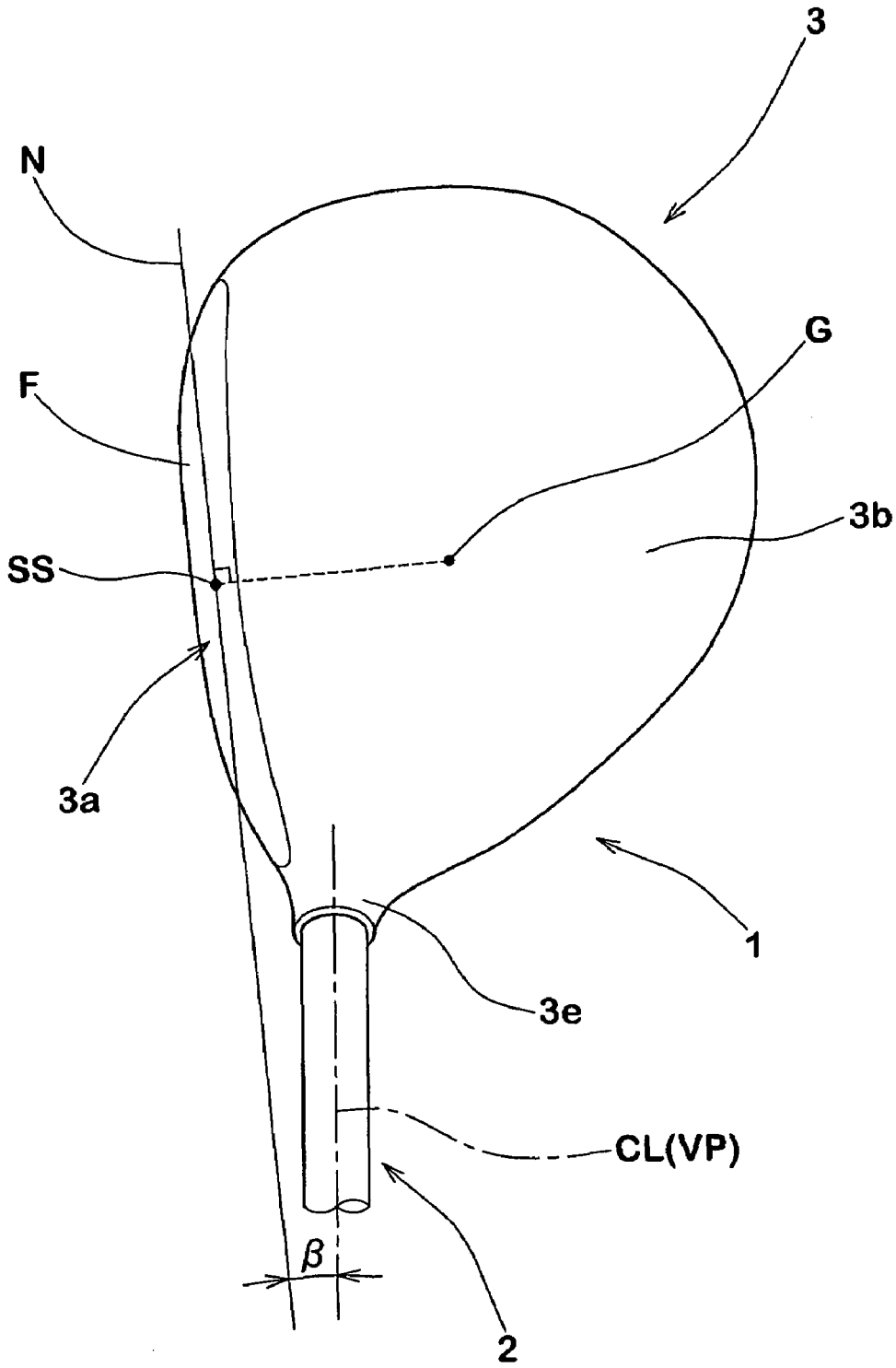
FIG. 3 is a front elevational view of FIG. 2.

Further, the golf club 1 in FIGS. 1 to 3 is shown in a standard condition. Here, the standard condition of the golf club is that the club head 3 is set on a horizontal plane HP so that the center line CL of the club shaft 2 is, within a vertical plane VP, inclined at its lie angle $\alpha$ with respect to the horizontal plane HP, and a club face F is inclined at its face angle $\beta$ with respect to the vertical plane VP, wherein the face angle $\beta$ is, as shown in FIG. 3, an angle between a horizontal tangential line N to a sweet spot SS on the club face F and the vertical plane VP.

Further, the sweet spot SS is set to a point at which a normal line drawn from the center of gravity G of the club head 3 intersects the club face F.

The club head 3, as illustrated in FIGS. 2 and 3, comprises: a face portion 3*a* whose front face defines the club face F for hitting a ball; a crown portion 3*b* intersecting the club face F at the upper edge thereof; a sole portion 3*c* intersecting the club face F at the lower edge thereof; a side portion 3*d* between the crown portion 3*a* and the sole portion 3*b* which extends from a toe-side edge to a heel-side edge of the club face F through the back face of the club head 3; and a hosel 3*e* to be attached to the tip end 2A of the club shaft 2.

The club head 3 in accordance with the present embodiment preferably comprises a hollow wood-type structure made of a metal material. Although the metal material is not particularly limited, one or two or more of an aluminum alloy, a titanium, a titanium alloy, a stainless or a magnesium alloy, and the like are used, for example. Further, the club head 3 can contain a non-metal material such as a fiber reinforcing resin (FRR) or the like at least in a part thereof.

Further, the club head 3 can be manufactured, for example, by preparing a plurality of (for example, two to four) parts for the club head, and approximately attaching the parts each other. The parts can be formed, for example, by casting, forging, press forming, or a combination thereof. Further, as a attaching method of the parts, for example, it is possible to employ welding, adhesive bonding, brazing, diffusion bonding, caulking, or the like.

Further, the club head 3 has a moment M of inertia around a center line CL of the club shaft 2 of not less than 6500 g×cm2, and more preferably not less than 6800 g×cm2. The club head 3 with the moment of inertia M of not less than 6500 g×cm2 is preferable. Since the club head has a large moment of inertia around a vertical axis passing through the center of gravity G of the club head 3, it is possible to get an excellent directionality of the hit ball by preventing the toe down.

If the moment of inertia M mentioned above of the club head 3 is too large, the club face F of the club head 3 is hard to be returned to an address state (which is normally in a square state) at a time hitting the ball, and the hit ball tends to slice. From this point of view, it is desirable that the moment of inertia M mentioned above is preferably not more than 8500 $g \cdot cm^2$, and more preferably not more than 8300 $g \cdot cm^2$.

The moment of inertia M mentioned above corresponds to a value of a club head simple substance. In this case, it is not necessary to remove a painting on the club head 3. Further, in the case that a cone-shaped cover or the like is arranged in a joint portion with the club shaft 2, the moment of inertia M is measured by taking this off.

Further, a measuring apparatus, for example, MOMENT OF INERTIA MEASURING INSTRUMENT manufactured by INERTIA DYNAMICS Inc. or the like is employed for measuring the moment of inertia M. The center line CL of the club shaft 2 in the club head simple substance is specified by a center line of a shaft insertion hole provided in the hosel 3*e*.

The volume of the club head 3 is not particularly limited, but it is desirable that the volume of the head is preferably not less than 350 cc, more preferably not less than 380 cc, and further preferably not less than 400 cc. Further, it is desirable that an upper limit thereof is preferably not more than 500 cc, and more preferably not more than 470 cc so as to satisfy a golf club rule defined by R&A or USGA. If the volume of the club head 3 is too small, there is a tendency that it is hard to enlarge the moment of inertia M mentioned above on the contrary, if the volume becomes too large, there is a tendency that the weight of the club head 3 is increased and the club head 3 is hard to be swung.

Further, the weight of the club head 3 is not particularly limited, but it is desirable that the weight is preferably not less than 170 g, more preferably not less than 175 g, and further preferably not less than 180 g. Further, it is desirable that an upper limit thereof is not more than 230 g, more preferably not more than 220 g, and further preferably not more than 210 g.

The inventor measured a deformation of the club shaft 2 in the toe down direction during the swing by using strain gauges. In particular, a plurality of strain gauges were attached to the club shaft 2 at a fixed distance, and a strain dispersion applied to the club shaft 2 at a time of swinging was measured. Great many clubs were used for the test. As a result, the inventor confirmed that a largest deformed portion just before the impact existed in a position 2G which separates about 200 mm distance from the end 4*e* of the grip 4 toward the club head 3.

Figure 9:
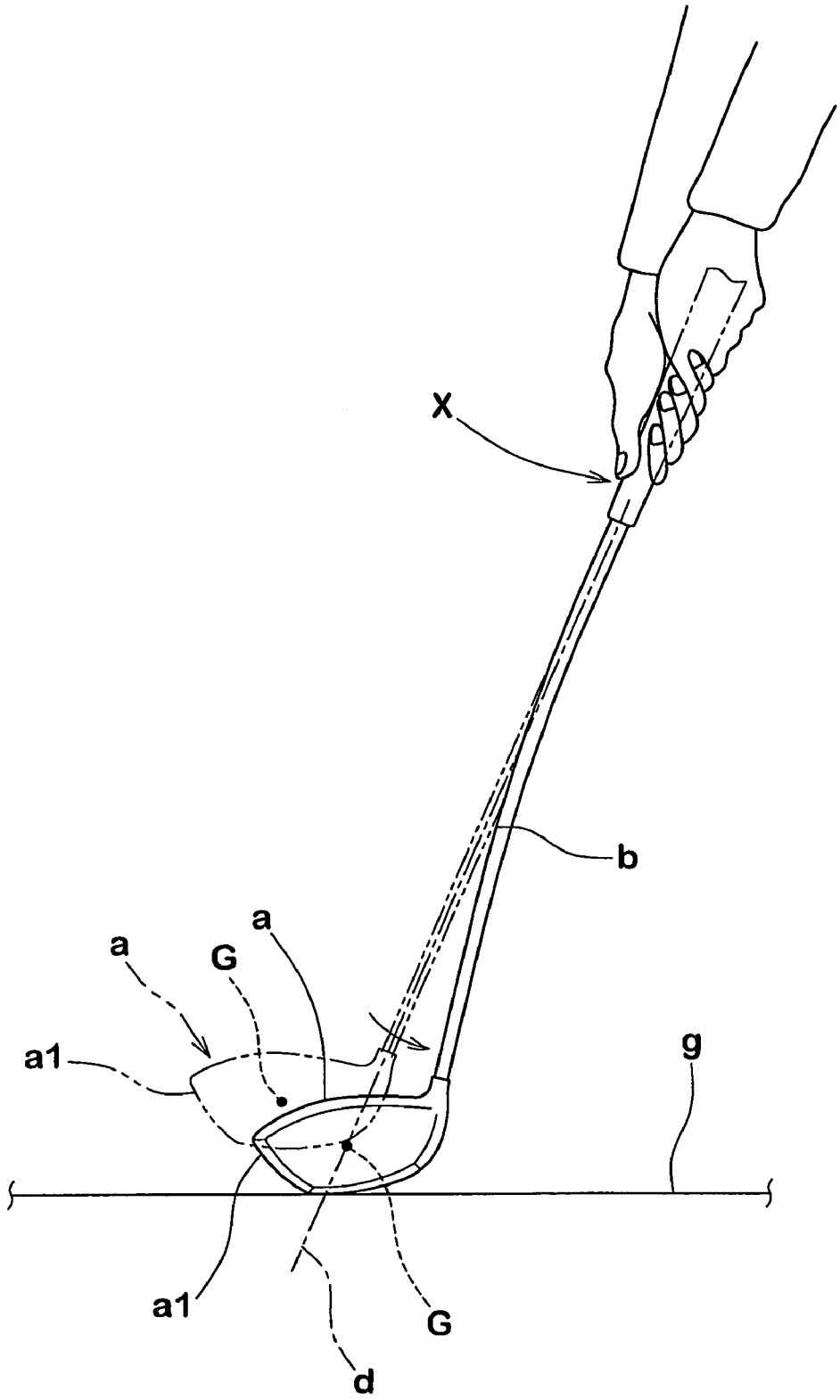
FIG. 9 is a front elevational view explaining a toe down phenomenon.

When a standard golfer grips the grip 4, a tip end x of a hand as shown in FIG. 9 is positioned at about 150 mm apart from the end 4*e* of the grip 4. Accordingly, the position 2G of the club shaft 2 exists a little forward (close to the club head) from the region in which the golfer grips the grip 4. It is considered that the large deformation generated at the position 2G makes the toe down.

The inventor of the present invention conducted various examinations with varying bending stiffness E of the club shaft 2. From the examinations, the inventor found out that it is possible to restrict the toe down smaller by setting the bending stiffness E at the position 2G to $5.0\times10^6$ $kgf \cdot mm^2$ or greater, thereby improving the carry and stabilizing the directionality of the hit ball.

Figure 4:
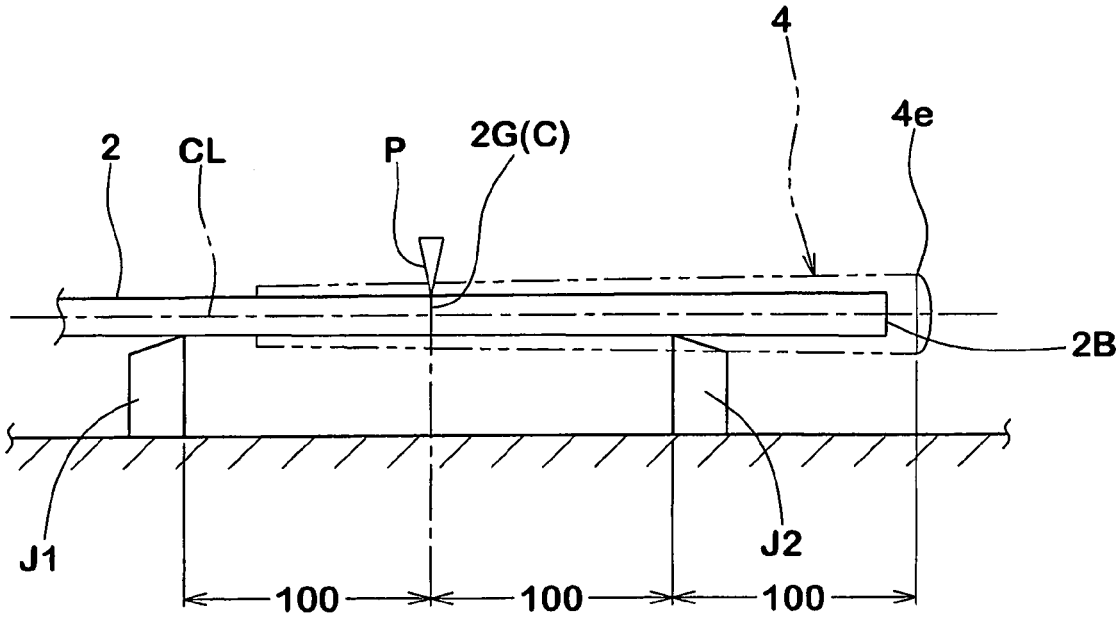
FIG. 4 is an expansion plan view of a plurality of prepreg plies forming a club shaft in accordance with the present embodiment.

Here, as shown in an enlarged view in FIG. 4, the end 4*e* of the grip 4 does not include a spherical convex provided on a bottom end of the grip 4, and is positioned outermost in a radial direction of the grip 4.

Further, the bending stiffness E of the club shaft 2 is measured by using a universal testing machine (e.g., a 2020 type manufactured by Intesco), for example, as shown in FIG. 4. In particular, the club shaft 2 is first supported such that the center line CL becomes horizontal by jigs J1 and J2 in which a distance between supporting points is set to 200 mm. At this time, the jigs J1 and J2 are positioned such that an center point C thereof forms the position 2G mentioned above of the club shaft 2. Next, an indenting tool P is moved down to the position 2G from the above. At this time, a descending speed of the indenting tool P is set to 5 mm/sec, the indenting tool P is stopped at a time point when a maximum load reaches 20 kgf, and a deflecting amount of the shaft 2 is measured. Further, the bending stiffness E is calculated on the basis of the following formula.

$$E=\{W\times(SL)^3\}/(48\times\delta)$$

wherein, w is the maximum load,

SL is the distance between the supporting points, and

δ is the deflecting amount of the club shaft.

In this case, with regard to units, a length is set to "mm" and a load is set to "kgf". Further, it goes without saying that the bending stiffness E is measured in a state in which the grip 4 is removed from the club shaft 2.

The toe down is effectively inhibited by setting the bending stiffness E in the position 2G of the club shaft 2 to be equal to or more than $5.0\times10^6$ $kgf \cdot mm^2$, more preferably not less than $5.5\times10^6$ $kgf \cdot mm^2$, and particularly preferably not less than $6.0\times10^6$ $kgf \cdot mm^2$. In this case, if the bending stiffness E becomes too large, the stiffness of the club shaft 2 is excessively increased, so that the club shaft 2 does not bow at all during the swing, and it is impossible to expect an improvement of the head speed by extension. This makes the hit ball hard to be up, and causes a reduction of the carry. Further, a hitting feeling becomes hard and a feeling is deteriorated. From this point of view, it is desirable that the bending stiffness E mentioned above is preferably not more than $9.0\times10^6$ kgf·mm$^2$, and more preferably not more than $8.5\times10^6$ kgf·mm$^2$.

Figure 5:
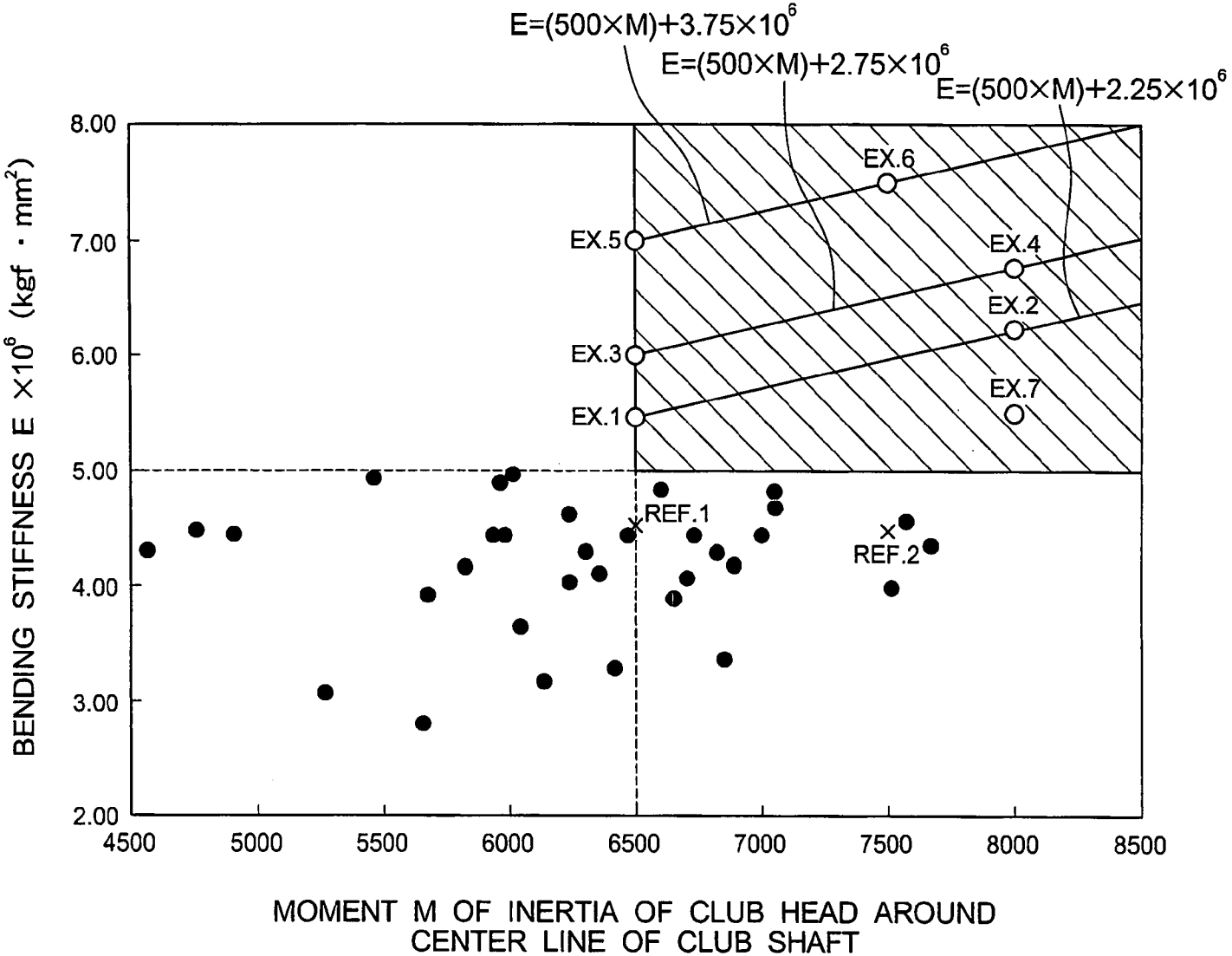
FIG. 5 is a graph showing the relationship between a bending stiffness and a moment of inertia of the club head around a shaft center line.

FIG. 5 shows a graph in which the bending stiffness E at the position 2G of the shaft 2 is set to a vertical axis, and the moment of inertia M of the club head 3 around the center line CL of the club shaft 2 is set to a horizontal axis. A hatched region shows a range including the golf club in accordance with the present invention. Black plots and x marks indicate the specification of the golf club out of the subject of the present invention.

In accordance with a particularly preferable aspect, it is desirable that a lower limit of the bending stiffness E at the position 2G of the club shaft 2 is defined as a function of the moment of inertia M mentioned above of the club head 3, and is increased in correspondence to the moment of inertia M. In general, there is a tendency that the toe down is largely generated in accordance with the golf club 1 with the larger moment of inertia M of the club head 3. Accordingly, in order to prevent the toe down, it is effective to make the bending stiffness E at the position 2G of the club shaft 2 larger in correspondence to the moment of inertia M. The inventor has found on the basis of various experiments that it is desirable to satisfy the following formula (1), more preferably the following formula (2) and further preferably the following formula (3).

$$E\geqq(500\times M)+2.25\times10^6 \quad (1)$$

$$E\geqq(500\times M)+2.75\times10^6 \quad (2)$$

$$E\geqq(500\times M)+3.75\times10^6 \quad (3)$$

Further, the club shaft 2 is formed in a hollow tubular body with a taper shape in which an outer diameter thereof is smoothly reduced toward the tip end 2A from the butt end 2B, as shown in FIG. 1.

The club shaft 2 mentioned above is, for example, made of a fiber reinforcing resin comprising a plurality of prepreg plies. Such a club shaft 2 is easily swung through due to its light weight, and has a high freedom of design. Accordingly, the bending stiffness at the specified position of the club shaft 2 can be easily adjusted. The club shaft 2 made of the fiber reinforcing resin as mentioned above can be easily formed, for example, in accordance with a sheet winding manufacturing method, a filament winding manufacturing method, an internal pressure molding method or the like.

Figure 6:
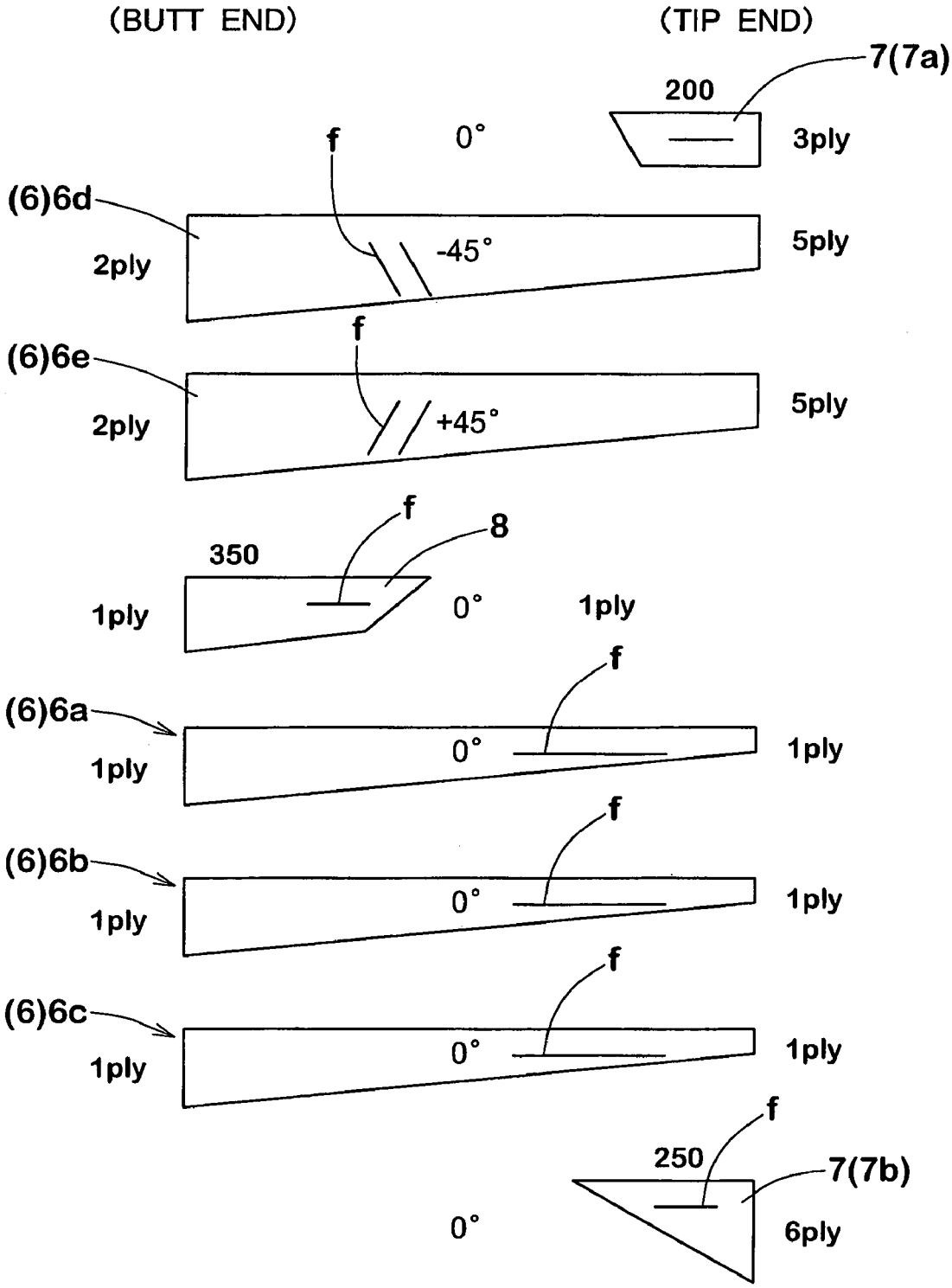
FIG. 6 is a front elevational view explaining a method of measuring the bending stiffness of the club shaft.

The prepreg ply is a sheet-like compound material of a reinforcing fiber dipped into a resin before the molding operation. FIG. 6 shows an embodiment of a set of the prepreg plies constructing the club shaft 2. The set of prepreg plies comprise at least one first prepreg ply 6 with an approximately entire length of the club shaft 2, at least one second prepreg ply 7 arranged in a small region extending from the tip end 2A toward the butt end 2B of the shaft 2, and at least one third prepreg ply 8 arranged in a small region extending from the butt end 2B toward the tip end 2A of the shaft 2.

The reinforcing fiber of the prepreg ply is not particularly limited, however, can employ, for example, a metal fiber such as an amorphous, a boron, a titanium, a tungsten, a stainless or the like, and an organic fiber such as an aramid, a polyparaphenylene benzobis oxazole (PBO) or the like, in addition to a carbon fiber or a glass fiber, and preferably, the carbon fiber is desirable. Further, in accordance with the custom, a matrix resin of the prepreg ply employs an unsaturated polyester, a phenol, a vinyl ester or the like. Above all, an epoxy resin is preferable.

In the present embodiment, the first prepreg ply 6 comprises three sheets of straight prepreg plies 6*a*, 6*b* and 6*c* with the reinforcing fibers f arranged in parallel to a longitudinal direction of the club shaft 2, and two sheets of bias prepreg plies 6*d* and 6*e* with the fibers f arranged so as to be inclined with respect to the longitudinal direction.

Each of the straight prepreg plies 6*a*, 6*b* and 6*c* preferably comprises the reinforcing fiber f with an elastic modulus in tension being in the range of from 10000 to 30000 kgf/mm$^2$. Further, each of the bias prepreg plies 6*d* and 6*e* preferably comprises the reinforcing fiber f with an elastic modulus in tension being larger than the straight prepreg ply, above all equal to or more than 24000 kgf/mm$^2$, more preferably not less than 30000 kgf/mm$^2$ and not more than 80000 kgf/mm$^2$, and more preferably not more than 60000 kgf/mm$^2$.

In general, there is a tendency that a tensile strength is lowered in accordance with the fiber with the larger elastic modulus in tension. Accordingly, it is desirable to secure the strength of the club shaft 2 by using the fiber in which the elastic modulus in tension is not more than 30000 kgf/mm$^2$ in the straight prepreg ply greatly affecting the bending strength of the club shaft 2. On the other hand, since the bias prepreg ply has a small effect applied to the bending strength of the club shaft 2, it is possible to obtain the shaft 2 having a small amount of fiber, a light weight and a small torsion (torque) by using the fiber in which the elastic modulus in tension is large as mentioned above. In this case, the elastic modulus in tension is assumed as a value measured in accordance with "carbon fiber testing method" of JIS R7601.

Further, the second prepreg ply 7 comprises two sheets of plies 7*a* and 7*b* with a length in a shaft axial direction of 200 to 350 mm (in which the embodiment includes two plies of 200 mm and 250 mm). The second prepreg ply 7 preferably comprises, for example, the reinforcing fiber f with the elastic modulus in tension being in the range of from 10000 to 30000 kgf/mm$^2$. Further, the fiber f is oriented in the longitudinal direction of the club shaft 2.

Further, the third prepreg ply 8 comprises one ply in the present embodiment with a length in the shaft axial direction of 200 to 350 mm, from the other end 2B of the club shaft 2. The ply 8 preferably comprises, for example, a high modulus fiber f with the elastic modulus in tension being in the range of from 26000 to 80000 kgf/mm$^2$. Further, the fiber f is oriented in the longitudinal direction of the club shaft 2, however, is not limited to this.

In this embodiment, each of the prepreg plies is, for example, wound around a rod-shaped core (not shown). At this time, in the present embodiment, the bias prepreg plies 6*d* and 6*e* are wound respectively at two circles in the butt end 2B of the club shaft and at five circles in the tip end 2A. The other prepreg plies are wound at one circle in both of the tip and the butt ends 2A and 2B. Further, a winded body of prepreg plies is heated and pressurized in an oven after being wrapped by a tape, for example, made of a polypropylene resin. Accordingly, the matrix resin of the prepreg plies in each of the layers is integrally hardened. Thereafter, the club shaft 2 is formed by pulling out the core. In this case, a display of an angle in FIG. 6 shows an angle of the fiber f after molding the resin with respect to the axial direction of the club shaft.

In this case, in order to adjust the bending stiffness E at the position 2G mentioned above of the club shaft 2, it is also effective to make the outer diameter of the position 2G large. Further, in addition to this, it is possible to achieve, for example, by increasing and reducing the elastic modulus in tension of the fiber, a fiber content and/or a laminating number of the prepreg ply.

Figure 7:
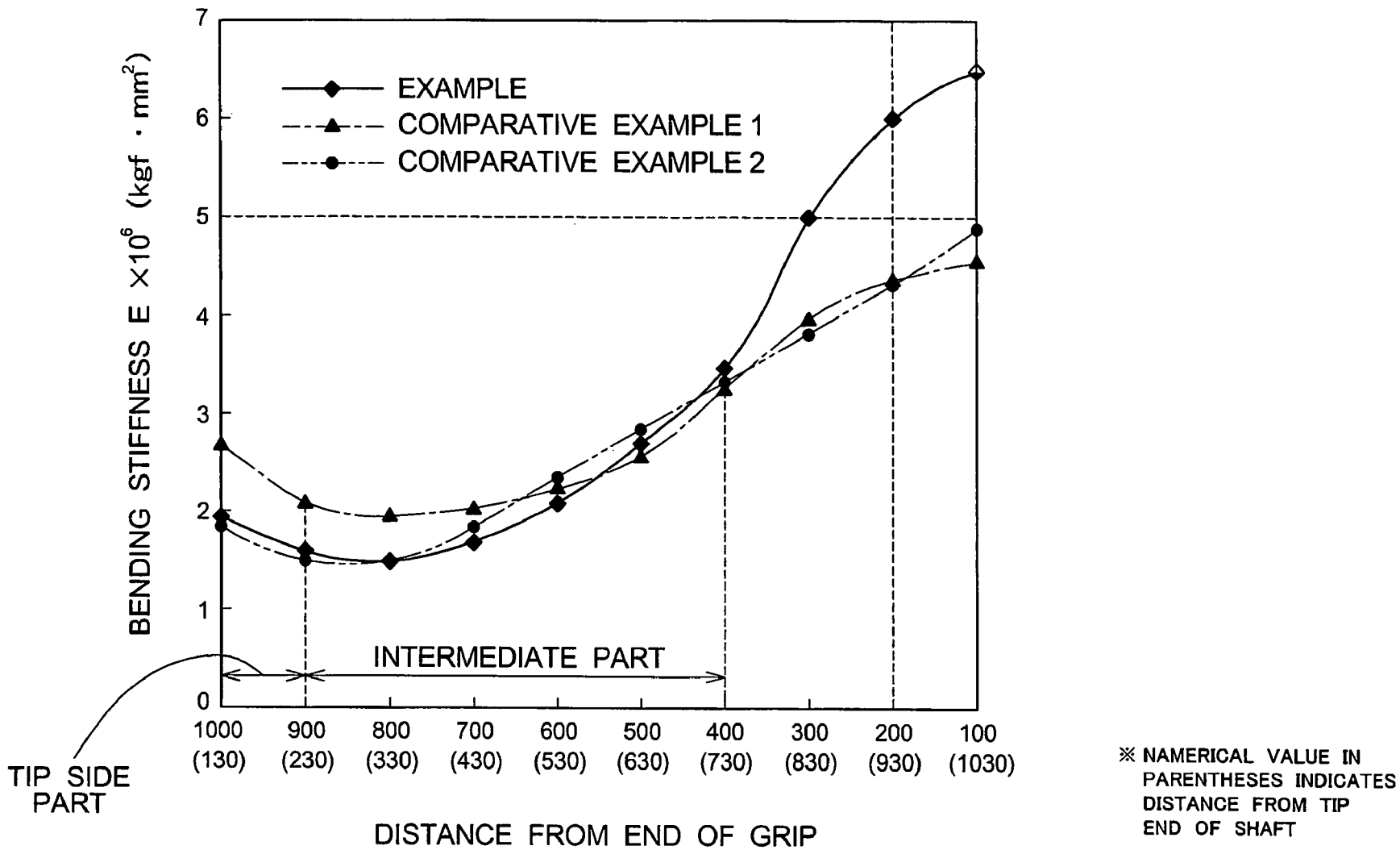
FIG. 7 is a graph showing a relation between a distance from an end of a grip toward the club head and the bending stiffness of shafts.
Figure 8:
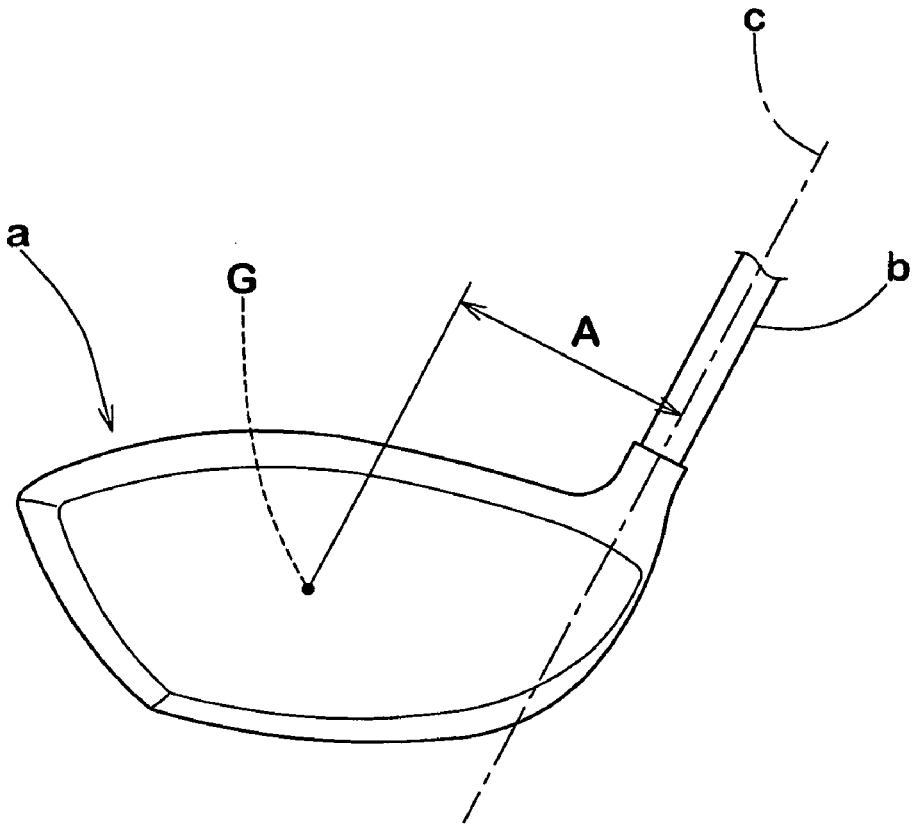
FIG. 8 is a front elevational view of the club head.

FIG. 7 is a graph showing a relation between a distance from the end 4*e* of the grip 4 toward the club head and a bending stiffness E at the position of shafts including an example in accordance with the present embodiment and comparative club.

In the example in accordance with the present embodiment, the bending stiffness at the position 2G which separates 200 mm from the end 4*e* of the grip 4 is apparently larger than the comparative examples. However, each bending stiffness of a tip side part and a intermediate part in accordance with the present embodiment shown as FIG. 7 is not different so much from the comparative examples.

In this embodiment, the tip side part of the club shaft 2 is a part with a length of 230 mm from the tip end 2A toward the butt end 2B, and the intermediate part of the shaft 2 corresponds to a part with a length of 500 mm from the tip side part (that is, a section between the position 230 mm apart from the tip end 2A and the position 730 mm apart from the tip end 2A).

In this embodiment, the bending stiffness of the tip side part of the club shaft 2 is defined in a range of from $0.5\times10^6$ kgf·mm$^2$ to $3.0\times10^6$ kgf·mm$^2$, and a change rate of the bending stiffness of the intermediate part of club shaft 2 is defined in a range of from 1500 to 7000 kgf·mm. Further, the club shaft 2 in accordance with the present embodiment has an inflection point roughly in a range of from 300 and 500 mm at a time when the bending stiffness is expressed by a function of the distance from the end 4*e* of the grip 4. Further, since the bending stiffness of the club shaft 2 is changed while drawing a smooth convex toward the end 4*e* of the grip from the inflection point, thereby preventing a rigidity step.

The bending stiffness of the tip side part of the club shaft 2 is measured in accordance with the method shown in FIG. 4, however, the indenting tool P is set to the position 130 mm apart from the tip end 2A of the shaft 2. Further, the jigs J1 and J2 are positioned so as to be 100 mm apart from the position of the indenting tool P respectively toward the tip end 2A side and the butt end 2B side, and a supporting span of the jigs J1 and J2 is set to 200 mm.

Further, the bending stiffness of the intermediate part of the club shaft 2 is determined by measuring a plurality of bending stiffness M1 to M6 while positioning the indenting tool P at the following six positions in accordance with the method shown in FIG. 4, and calculating an average value of the bending stiffness M1 to M6. At this time, the jigs J1 and J2 are provided at positions respectively 100 mm apart from the position of the indenting tools P toward the tip end 2A side and the butt end side 2B so as to set the supporting span to 200 mm.

| Position of Indenting Tool (Distance from tip end of Shaft) | Bending Stiffness |
|---|---|
| 230 mm | M1 |
| 330 mm | M2 |
| 430 mm | M3 |
| 530 mm | M4 |
| 630 mm | M5 |
| 730 mm | M6 |

Further, the change rate J (unit: kgf·mm) of the bending stiffness in the intermediate part of the shaft 2 is obtained in accordance with the following manner.

$$J=(H1+H2+H3+H4+H5)/5$$

In this case, the values H1 to H5 are obtained from the bending stiffness M1 to M6 at the respective positions of the intermediate part of the club shaft in accordance with the following formulas (unit of divisor 100 is mm).

$$H1=(M2-M1)/100$$

$$H2=(M3-M2)/100$$

$$H3=(M4-M3)/100$$

$$H4=(M5-M4)/100$$

$$H5=(M6-M5)/100$$

In this case, the club shaft shown in FIG. 7 is finished at an entire length 1130 mm by manufacturing at 46 inch (1168 mm), and cutting the butt end side at 38 mm without cutting the tip end side. The change rate of the bending stiffness of the intermediate part in each of the shafts 2 is as follows.

Example: 3800 kgf·mm

Comparative Example 1: 2400 kgf·mm

Comparative Example 2: 3700 kgf·mm

An entire length L of the club 1 in accordance with the present invention is not particularly limited, however, if the entire length L is too small, it is not sufficiently expected to improve a head speed utilizing the length of the club, and there is a tendency that the corresponding carry required for this kind of club is hard to be obtained. On the contrary, in the case that the entire length L is too large, there is a tendency that the golfer feels the club long at a time of coming to the ready and a sense of insecurity is generated in the golfer, in addition to a reduction of a meet rate. From this point of view, it is desirable that the entire length L of the club 1 is preferably not less than 44 inch, and more preferably not less than 45 inch, and an upper limit thereof is preferably not more than 48 inch, more preferably not more than 47 inch, and further preferably not more than 46 inch.

The entire length L of the golf club 1 corresponds to a length obtained by measuring from the end 4*e* of the grip 4 to the intersecting point P between the horizontal plane HP and the center line CL of the club shaft along the center line CL, in the standard condition shown in FIG. 1.

Comparison Test:

A driver golf club with a whole length of 45 inch was manufactured on the basis of Table 1, and a directionality and a carry of the hit ball were tested. In examples and comparative examples, each of the heads comprises a two-piece body which has a main body formed by forging 6-4 Ti and a face plate made of 6-4 Ti of rolled material. Further, with respect to each of the heads, three kinds in which the head volume is 420 cc, 450 cc and 480 cc were prepared. Moments of inertia of the heads around the center line of the shafts were respectively set to 6520 g·cm$^2$, 7500 g·cm$^2$ and 8000 g·cm$^2$.

Further, the club shafts were made of a fiber reinforcing resin comprising a plurality of prepreg plies manufactured by Toray Industries Inc. An expansion plan view of the prepreg is as shown in FIG. 6. Further, with respect to the example 1, each of the prepreg plies is constituted by a carbon fiber and an epoxy resin with a resin content of 25%, and has the following fiber specification.

Bias Prepreg Ply:

Fiber: M40J (elastic modulus in tension 38443 kgf/mm$^2$)

Straight Prepreg Ply:

Fiber: M30S (elastic modulus in tension 30000 kgf/mm$^2$)

Second Prepreg Ply:

Fiber: T700S (elastic modulus in tension 23453 kgf/mm$^2$)

Carry of Hit Ball:

The test was executed by calculating a difference between a maximum value and a minimum value of the carry per the golfers, and determining an average value of fourteen golfers. The smaller the numerical value is, the smaller the dispersion of the carry is, and the better the carry is. Results of the test and the like are shown in Table 1.

TABLE 1

| | Comparative Ex. 1 | Comparative Ex. 2 | Ex. 1 | Ex. 2 | Ex. 3 | Ex. 4 | Ex. 5 | Ex. 6 | Ex. 7 |
|---|---|---|---|---|---|---|---|---|---|
| Moment of Inertia M [g · cm$^2$] | 6520 | 7500 | 6520 | 8000 | 6520 | 8000 | 6520 | 7500 | 8000 |
| Bending Stiffness E [×10$^6$ kgf · mm$^2$] | 4.50 | 4.50 | 5.50 | 6.25 | 6.00 | 6.75 | 7.00 | 7.50 | 5.50 |
| Sufficiency of E ≧ 500M + 2.25 × 10$^6$ | x | x | ○ | ○ | ○ | ○ | ○ | ○ | x |
| Sufficiency of E ≧ 500M + 2.75 × 10$^6$ | x | x | ○ | x | ○ | ○ | ○ | ○ | x |
| Sufficiency of E ≧ 500M + 3.75 × 10$^6$ | x | x | x | x | x | x | ○ | ○ | x |
| Stability of Carry [yard] | 39.2 | 42.3 | 33.4 | 34.8 | 30.7 | 31.9 | 23.5 | 27.5 | 36.6 |
| Stability of Directionality [yard] | 50.4 | 56.2 | 42.7 | 40.6 | 39.3 | 37.5 | 34.1 | 33.8 | 46.7 |

Third Prepreg Ply:

Fiber: M30J (elastic modulus in tension 30000 kgf/mm$^2$)

Further, in the club shafts in accordance with the other examples and comparative examples, the bending stiffness at the position 2G is adjusted by changing the elastic modulus in tension of the fiber and the fiber content of the third prepreg on the basis of the prepreg ply in accordance with the example 1. The distribution of the bending stiffness of the club shaft is set to the aspect shown in FIG. 7 in the tip side part and the intermediate part, and the value at the position 200 mm apart from the end of the grip is ascended and descended in the hand side on the basis of the curve shown in FIG. 7. The testing method is as follows.

Directionality of Hit Ball:

The test was executed by hitting every ten balls constituted by a commercially available three-piece golf ball ("Hi-BRID everio" manufactured by SRI Sports Co., Ltd.) by fourteen golfers having handicaps between 3 and 25, measuring a shortest distance from a straight line obtained by connecting a target and a hitting point to a ball stop position (the measured value is set to a plus value whichever the ball is shifted to the right or the left with respect to the target), and calculating an average value of ten balls in each of the golfers. Further, an evaluation is executed by determining an average value of fourteen golfers. The smaller the numerical value is, the better the directionality is.

The invention claimed is:

1. A golf club comprising a club shaft having a tip end and a butt end, a club head being attached to the tip end of the club shaft, and a golf grip being attached to a region of the club shaft extending from the butt end toward the tip end of the club shaft, the golf grip having an end by the side of the butt end of the club shaft, wherein the club head has a moment (M) of inertia around a center line of the club shaft of not less than 7500 g·cm$^2$, and the club shaft has a bending stiffness (E) of not less than 5.0×10$^6$ kgf·mm$^2$ at the position which separates 200 mm from the end of the grip toward the club head.

2. The golf club according to claim 1, further satisfying the following relation:

$$E \geqq (500 \times M) + 2.25 \times 10^6.$$

3. The golf club according to claim 1, further satisfying the following relation:

$$E \geqq (500 \times M) + 2.25 \times 10^6.$$

4. The golf club according to claim 1, further satisfying the following relation:

$$E \geqq (500 \times M) + 2.25 \times 10^6.$$

5. The golf club according to claim 1, wherein the club head is a wood-type having the volume of not less than 350 cc, and the golf club has a whole length of not less than 44 inch.

6. The golf club according to claim 1, wherein the moment (M) of inertia is not more than 8500 $g \cdot cm^2$, and the bending stiffness (E) is not more than $9.0 \times 10^6$ $kgf \cdot mm^2$.

7. The golf club according to claim 1, wherein the moment (M) of inertia is not more than 8300 $g \cdot cm^2$.

8. The golf club according to claim 1, wherein the club shaft has a tip side part having a length of 230 mm from the tip end toward the buff end of the club shaft, and the bending stiffness of the tip side part is in the range of from $0.5 \times 10^6$ to $3.0 \times 10^6$ $kgf \cdot mm^2$.

* * * * *

UNITED STATES PATENT AND TRADEMARK OFFICE

CERTIFICATE OF CORRECTION

PATENT NO. : 7,318,780 B2
APPLICATION NO. : 11/269794
DATED : January 15, 2008
INVENTOR(S) : Hitoshi Oyama It is certified that error appears in the above-identified patent and that said Letters Patent is hereby corrected as shown below:

In the Claims

*** Correct Claim 3 and Claim 4 at column 10, lines 60-67 as follows:

In Claim 3, column 10, line 63, change "$E \geq (500xM) + 2.25\ x10^6$" to read -- $E \geq (500xM) + 2.75\ x10^6$ --; and In Claim 4, column 10, line 67, change "$E \geq (500xM) + 2.25\ x10^6$" to read -- $E \geq (500xM) + 3.75\ x10^6$ --. ***

Signed and Sealed this

Twenty-fourth Day of November, 2009

David J. Kappos

David J. Kappos
*Director of the United States Patent and Trademark Office*